US005662037A

United States Patent [19]

van Haag

[11] Patent Number: 5,662,037

[45] Date of Patent: Sep. 2, 1997

[54] CALENDER FOR TREATING BOTH SIDES OF A WEB OF PAPER

[75] Inventor: Rolf van Haag, Kerken, Germany

[73] Assignee: Voith Sulzer Finishing GmbH, Krefeld, Germany

[21] Appl. No.: 617,020

[22] Filed: Mar. 18, 1996

[30] Foreign Application Priority Data

Mar. 27, 1995 [DE] Germany ..... 195 11 145.1

[51] Int. Cl.[6] ..... D21G 1/00; B30B 3/04

[52] U.S. Cl. ..... 100/331; 100/162 B; 100/163 A; 100/332

[58] Field of Search ..... 100/93 RP, 161, 100/162 R, 162 B, 163 R, 163 A, 164–166, 170

[56] References Cited

U.S. PATENT DOCUMENTS

| | | | |
|---|---|---|---|
| 2,300,994 | 11/1942 | Thiele et al. | 100/163 R |
| 2,926,600 | 3/1960 | Engelgau | 100/162 R |
| 3,340,796 | 9/1967 | Link | 100/170 |
| 3,373,681 | 3/1968 | Jaegers | 100/163 R |
| 3,611,917 | 10/1971 | Bryce et al. | 100/162 B |
| 4,729,153 | 3/1988 | Pav et al. | 100/163 A |
| 4,736,678 | 4/1988 | Stotz | 100/163 A |
| 4,813,349 | 3/1989 | Pav et al. | 100/162 B |
| 4,823,690 | 4/1989 | Stotz | 100/163 A |
| 4,903,517 | 2/1990 | Van Haag et al. | 100/163 R |
| 5,237,915 | 8/1993 | Rounsley | 100/161 |
| 5,438,920 | 8/1995 | Kiovukunnas et al. | 100/163 A |

FOREIGN PATENT DOCUMENTS

| | | | |
|---|---|---|---|
| 0 230 563 | 8/1987 | European Pat. Off. . | |
| 2237584 | 5/1991 | United Kingdom | 100/162 R |

OTHER PUBLICATIONS

"Die neuen Superkalanderkonzepte", Voith Sulzer Papiertechnik, 1994, No. 05/94 d.

*Primary Examiner*—Stephen F. Gerrity
*Attorney, Agent, or Firm*—Darby & Darby

[57] ABSTRACT

A calender for treating both sides of a web of paper includes a roller stack. A working nip is formed between the juncture of one hard roller and one soft roller. A changeover nip is formed between the juncture of two soft rollers. The roller stack has eight rollers. The two middle rollers form the changeover nip. One of the middle rollers is a deflection adjustment roller and has an upper support device which can be pressure loaded and a lower support device which also can be pressure loaded. The supporting force that is exerted on the jacket by the upper support device is greater than the supporting force that is exerted by the lower support device.

11 Claims, 1 Drawing Sheet

Fig.1
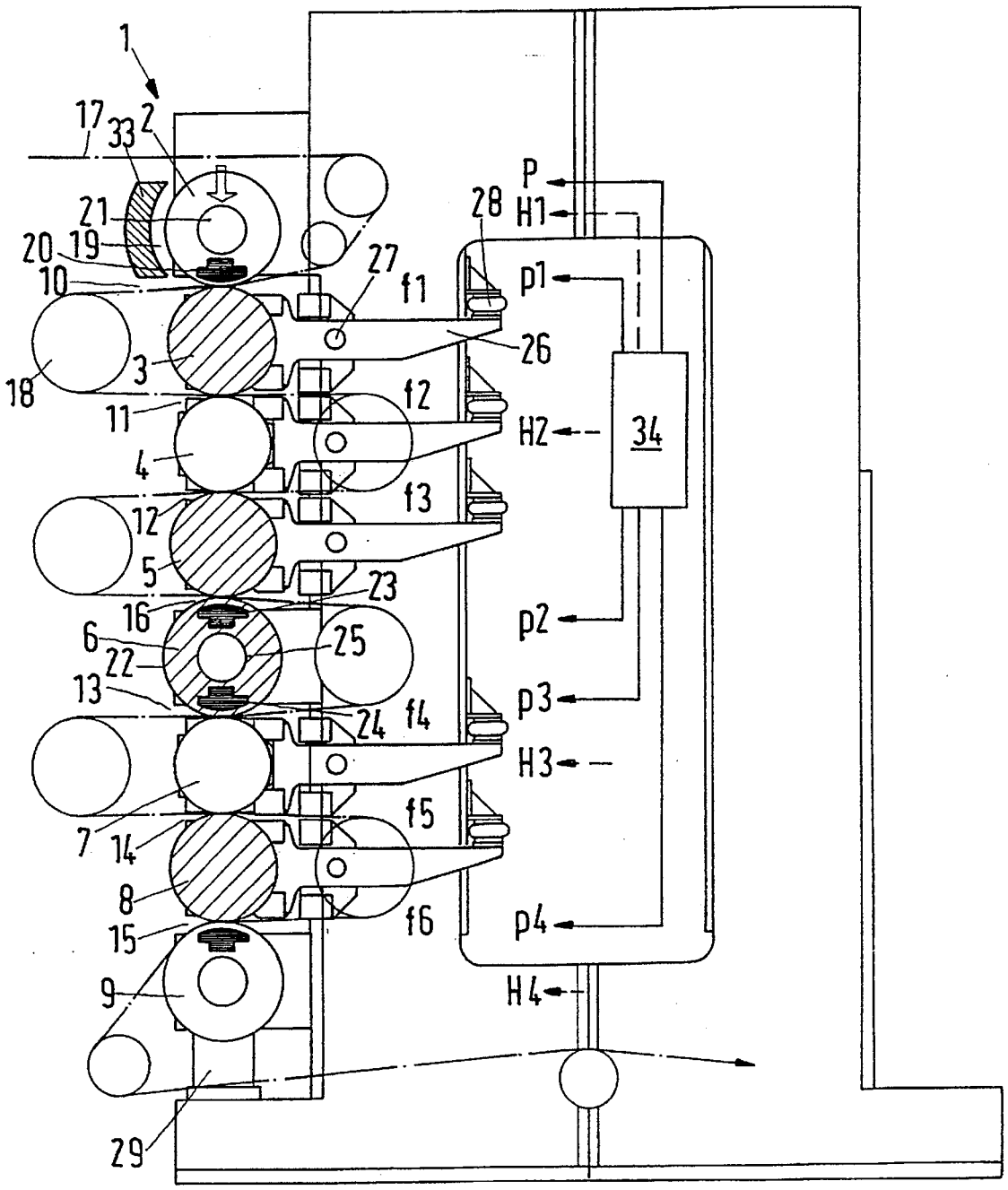
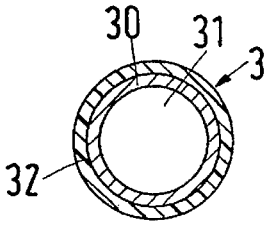
Fig.2

CALENDER FOR TREATING BOTH SIDES OF A WEB OF PAPER

BACKGROUND OF THE INVENTION

1. Field of the Invention

The present invention relates to a calender for treating both sides of a web of paper. More specifically, the present invention relates to a calender having a roller stack which has a hard top roller, a hard bottom roller, and hard and soft rollers disposed between the top roller and the bottom roller. Working nips are formed between the juncture of one hard roller and one soft roller. A changeover nip is formed between the juncture of two soft rollers. The roller stack can be loaded in the direction of the stack by a force acting on one of the ends of the stack.

2. Discussion of the Related Art

Calenders for treating both sides of a paper web are known, for example, from the advertising brochure, "The new supercalender designs", dated May 1994, from the finn of Sulzer Papertee GmbH. These supercalenders are used to glaze coated and uncoated papers, for example, printing papers or silicon base papers. Metal rollers having a smooth and hard outer surface are known as "hard" rollers, and are primarily responsible for affecting the surface structure, such as smoothness and gloss, of the treated papers. Rollers having a flexible or soft outer surface are known as "soft" rollers, and primarily provide for uniform compression of the paper. A changeover nip is necessary so that both sides of the web of paper undergo approximately the same treatment. A supercalender typically has from 12 to 16 rollers, and the changeover nip is located in the lower half of the stack. The changeover nip is disposed in the lower half of the stack to take into account the fact that the web of paper which is running through the stack, from the top towards the bottom, is smoothed to a lesser extent at the top of the stack than at the bottom of the stack because the loading, including the weights of the rollers and the parts that may be attached to them, such as protruding weights, increases towards the bottom of the stack. This increase in the load causes the line load, compressive stress, and/or a dwell time in the working nips to increase from the top towards the bottom. As a result, these supercalenders have a great overall height, and are very expensive because of the large number of rollers.

From European reference No. EP 0 230 563 A1 a device is known which has a roller stack having seven rollers. The top roller, the bottom roller and the middle roller are configured as deflection adjustment rollers. The remaining rollers are mounted on levers. Hydraulic servomotors, which act on the levers, or more specifically, on the ends of the deflection adjustment rollers, are used to raise, lower or hold the desired position of the roller surface. The servomotors relieve the remaining rollers of the effects of any protruding weights.

SUMMARY OF THE INVENTION

It is an object of the present invention to provide a calender for treating both sides of a web of paper that provides the same glazing results for a given type of paper as supercalenders according to the prior art, but which has a lower overall height and reduced costs of manufacture and operation.

In accordance with a preferred embodiment demonstrating further objects, features and advantages of the present invention, the roller stack has eight rollers. The two middle rollers of the stack form the changeover nip. One of the middle rollers is a deflection adjustment roller. The jacket of one of the intermediate rollers is supported on a carrier which passes through the jacket. The jacket is supported by an upper support device which can be pressure loaded and a lower support device which also can be pressure loaded. The supporting force which is exerted on the jacket by the upper support device is greater than the supporting force which is exerted on the jacket by the lower support device. With this structural arrangement, the number of working nips disposed above the changeover nip is the same as the number of working nips disposed below the changeover nip.

There are less working nips disposed above the changeover nip according to the present invention than in the known supercalenders. In spite of this fact, the same glazing results are achieved by the present invention as with a 12-roller calender because the processing can be carried out with a relatively greater line load in all of the working nips. In particular, the middle deflection adjustment roller causes the side of the paper which lies against the hard rollers disposed above the changeover nip to experience treatment which is similar to that of the side of the paper which lies against the hard rollers disposed below the changeover nip. It is possible to work with the maximum permissible compressive stress both in the lowest working nip of the lower half of the stack in the lowest working nip in the upper half of the stack. The compressive stress in the nips disposed above the changeover nip can also be correspondingly great. The three working nips above the changeover nip in the 8-roller calender achieve the same result as the first seven working nips in a 12-roller calender because the middle deflection adjustment roller can be adjusted by an upper and a lower support device. A further advantage of the use of a middle deflection roller is that the rollers can be separated from each other in a conventional manner, for example, through the lowering of the lower roller.

Since the calender of the present invention has a lower overall height, lower buildings can also be used, which substantially reduces the set-up costs. In addition, because of the lower number of rollers, the calender is less expensive both in terms of its manufacturing costs and its operating costs.

Preferably, one of the two middle rollers is a deflection adjustment roller. The decoupling of the upper and the lower loading systems is especially great because of the use of a flexible jacket in the deflection adjustment roller, which jacket can be more easily deformed than conventional jackets made of a fibrous material.

Preferably, the fifth roller from the top is the deflection adjustment roller. Therefore, the effect of the roller weight on the lowest working nip is as minimal as possible.

It is also preferable for the intermediate rollers, with the exception of the deflection adjustment roller, to be mounted on levers which are loaded by means of compensators to balance out any protruding weights. In this way, it is assured that only the roller weights, and not the protruding weights, are applied to the line load which prevails in each of the working nips. This structural arrangement yields a steep load characteristic curve, which makes it possible to work with a relatively high line load in all of the working nips.

The sum of the line loads in the working nips disposed above the changeover nip is between 80 percent and 120 percent of the sum of the line loads of the working nips disposed below the changeover nip. The sum of the line loads is a good point of reference to determine the mechanical effect on the paper. Even if the sum of the line loads above the changeover nip is not identical to the sum of the line loads below the changeover nip, outstanding glazing results can still be obtained, which fully meet the demands of practical operations.

The calendering performance (e.g., the mechanical effect on the paper) can be better determined by maintaining the sum of the products of the dwell time and average compressive stress in each of the working nips disposed above the changeover nip between 80 percent and 120 percent of the sum of the products of the dwell time and average compressive stress in the working nips disposed below the changeover nip. This is because the dwell time and the compressive stress are two directly dependent factors in the treating of paper.

The rollers themselves preferably have a low weight. The hard rollers preferably have the smallest possible diameter and the thinnest possible wall thickness. The soft rollers use lighter structural materials in place of conventional compact and heavy rollers, which have an outer paper covering. Additionally, the soft rollers preferably have cavities. The soft rollers are preferably formed from hollow tubes which are provided with an outer flexible plastic jacket covering. Such coverings are substantially thinner than paper coverings and are correspondingly lighter. The jacket is preferably made of fiber-reinforced plastic, such as an epoxy resin. The fiber reinforcement, preferably carbon fiber, provides high strength combined with relatively low weight.

At least one hard roller can be heated. Thus, thermal deformation energy can be added so that the treating can be carried out with a lower overall line load. Additionally, an even higher degree of matching of the glazing results on both sides of the web of paper can be achieved by varying the amount of heat that is applied in each working nip.

The upper and/or lower roller can preferably be heated. Thus, heat can be applied in the first and last working nip, to make corrections on both sides of the web of paper.

The upper and/or lower roller is preferably a deflection adjustment roller so that the line load can be maintained constant over the width of the web of paper. Thus, the paper will be glazed uniformly.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein:

FIG. 1 is a schematic illustration of a calender in accordance with the present invention; and FIG. 2 is a cross-sectional view through a soft roller.

DETAILED DESCRIPTION OF THE PREFERRED EMBODIMENT

Referring now to FIG. 1, a calender 1, according to the present invention, is illustrated. The calender includes a roller stack which is comprised of eight rollers, namely, a heatable, deflection-controlled hard upper roller 2, a soft roller 3, a heatable hard roller 4, a soft roller 5, a deflection-controlled soft roller 6, a heatable hard roller 7, a soft roller 8, and a heatable, deflection-controlled hard lower roller 9. Thus, six working nips 10, 11, 12, 13, 14 and 15 are formed by the juncture of one hard roller and one soft roller. Additionally, a changeover nip 16 is formed by the juncture of the two soft rollers 5 and 6.

A web of paper 17 is guided from a conventional paper machine (not shown) and is guided through the calender by guide rollers 18 through the working nips 10–12, the changeover nip 16 and the working nips 13–15, whereupon the web is wound in a conventional winding device (not shown). In the upper three working nips 10–12, one side of the web of paper 17 contacts against hard rollers 2, 4. In the three lower working nips 13–15, the other side of the paper 17 contacts against hard rollers 7, 9. In this manner, the desired surface structure, for example, gloss or smoothness, is achieved on both sides of the paper web 17.

Upper roller 2 and lower roller 9 are preferably deflection adjustment rollers. In other words, their respective roller jackets 19 are each supported by a series of support elements 20 on a fixed (i.e., non-rotatable) carrier 21. Soft roller 6 is also preferably a deflection adjustment roller. Soft roller 6 has a jacket 22 that is supported by an upper support device 23 and a lower support device 24. Both upper support device 23 and lower support device 24 are formed by a series of support elements disposed on a fixed carrier 25. Soft roller 6 has an outer jacket 22, which in its entirety, can be adjusted vertically with respect to carrier 25. Deflection adjustment rollers of such type are known, for example, from NIPCO™ or HYDREIN™ rollers. The support elements can also be replaced by other known supporting devices.

The remaining rollers 3, 4, 5, 7 and 8 are supported, by their respective bearing journals, on levers 26. Levers 26 are pivoted around pivot points 27 that are fixed on the frame. Each of the levers can be loaded at their free end by a compensator 28. Compensators 28 compensate for the effect of any protruding weights, for example, the guide rollers 18, and therefore keep the effective weight of the associated rollers small. The compensators 28 can be loaded in any desired fashion, for example, by a spring or by fluid pressure.

To separate the rollers of the roller stack, the carrier of the lower roller 9 can be lowered by a lifting cylinder 29. When lower roller 9 is lowered, the rollers 3, 4, 5, 6, 7 and 8, which are each supported on levers 26, are also lowered until the levers abut against a lower stop (not shown), which is incorporated into the compensator. Soft roller 6 is also lowered until the roller is stopped by an internal lower stop. If a nip width of, for example, 4 mm is to result between all of the rollers, it must be possible to move roller 3 downwardly by 4 mm, roller 4 downwardly by 8 mm, roller 5 downwardly by 12 mm, and the jacket 22 of roller 6 downwardly by 16 mm.

Referring now to FIG. 2, the soft rollers, for example, soft roller 3, have an interior carrier tube 30 with a cavity 31. A plastic jacket 32 is disposed about tube 30. Plastic jacket 32 is preferably made of a fiber-reinforced epoxy resin. A soft roller made according to this construction is substantially lighter than a conventional soft roller, which has an outer covering made of a fibrous material.

One or more of the hard rollers 2, 4, 7, 9 can be heated, as is indicated by the arrows H1, H2, H3 and H4. To effect this heating, the upper roller 2, may, for example, include an induction heating unit 33. However, it is to be understood that heat energy can be applied to the hard rollers by other devices, such as, for example, electric resistance heating units, radiant heating units, thermal conductors, or other similar devices as are known in the art.

A control device 34 coordinates the individual parameters of the paper treatment. Thus, in addition to controlling the heat energy H1–H4 that is applied, the force P that it is be applied downwardly on the upper roller 2 is also controlled. It is to be noted that it is preferable to fixedly hold the lower roller 9 in place while downward force P is applied to upper roller 2. However, the loading can also be carried out in the opposite direction, such that force P acts upwardly on the lower roller 9 and the upper roller 2 is fixedly mounted in position. The pressures p1, p2, p3 and p4, which are fed, individually or in zones, to the support elements in all three of the deflection adjustment rollers 2, 6, 9 provide a uniform compressive stress over the entire axial length of the rollers. In addition, the support devices 23 and 24 of soft roller 6 are biased in such a way that the force which is acting in an upward direction is larger than the force which is acting in a downward direction. Thus, the working nips 10–12 in the upper part of the stack 1 and the working nips 13–15 in the lower part of the stack are decoupled from one another, so that the three upper working nips treat the one side of the paper web in a manner similar to that in which the three lower working nips treat the other side of the paper web.

If the stack is loaded by a force P, a line load f1 is applied in the first working nip 10. Load f1 is dependent on the force P and the effective weight of the upper roller 2. A line load f2 is applied in the second working nip 11, which is dependent on the force P and the effective weights of both of upper rollers 2 and 3. Similarly, a line load f3 is also applied in the third working nip 12, which is dependent on the force P and the effective weights of rollers 2–4. Force P and the effective weights of rollers 2–4 are supported by the upper support device 23. The three line loads f4, f5 and f6 applied in the working nips 13–15, respectively, lie below changeover nip 16 and upper support device 23. Line loads f4, f5 and f6 are completely independent of force P and the effective weights of rollers 2–4 because these loads are supported by device 23. Line load f4 in working nip 13 is solely dependent upon the force which is generated by the lower support device 24. Line load f5 in working nip 14 is greater than load f4 by the amount of the effective weight of roller 7. Similarly, line load f6 in working nip 15 is greater than load f4 by the effective weight of the rollers 7 and 8. Force P and the force applied by lower supported device 24 are controlled so that the sum of the line loads f1+f2+f3 of the top three working nips 10, 11 and 12 is about 80 percent to 120 percent, and preferably about 100 percent, of the sum of the three line loads f4+f5+f6 of the three bottom working nips 13, 14 and 15.

Similar results can be achieved if, instead of the line load in the individual nips, one takes into account the dwell time and the compressive stress applied in each working nip. The sum of the products of the dwell time and the average compressive stress for the three top working nips can be compared with the sum of the products of the dwell time and compressive stress for the three bottom working nips. The sum of the products of the upper three working nips should amount to 80 percent to 120 percent of the sum of the products of the lower three working nips.

With this arrangement, the treatment in the first three working nips 10, 11 and 12 so closely matches the treatment in the last three working nips 13, 14 and 15, that even the glazing effect is, to a large extent, the same on both sides of the web of paper. Any further corrections which might be needed, can be carried out by varying the heating of the heatable rollers 2, 4, 7 and 9.

Compressive stress values of between 42 and 60 $N/mm^2$ are preferably applied in the working nips and particularly in the lowest working nips 12 and 15 of each half of the stack. With the aid of heating H1 through H4, the heatable rollers 2, 4, 7 and 9 preferably obtain a surface temperature of between 100° and 150° C. The diameters of the soft rollers and the elasticity of their coverings 32 are preferably chosen so that a nip width of about 2 to 15 mm, and preferably about 8 mm, will result. Depending on the speed of the web, such a gap width will cause the dwell times to range from 0.1 to 0.9 ms in each working nip and preferably from 0.2 to 0.5 ms. In a preferred embodiment, the surface temperature of the heatable rollers is only slightly above the lower limit, for example, 110° C. In addition, the compressive stress is preferably only slightly above the lower limit, for example, 50 $N/mm^2$ . As a result, when compared with a 12-roller calender, the present invention only requires slight increases in the applied thermal and mechanical energy to achieve substantially the same results with an 8-roller calender.

Having described the presently preferred exemplary embodiments of a calender for treating both sides of a web of paper in accordance with the present invention, it is believed that other modifications, variations and changes will be suggested to those skilled in the art in view of the teachings set forth herein. It is, therefore, to be understood that all modifications, variations and changes are believed to fall within the scope of the present invention without departing from the spirit and scope of the invention as described above.

What is claimed is:

1. A calender for treating both sides of a web of paper, said calender comprising:

a roller stack having a hard top roller, a hard bottom roller, and a plurality of intermediate hard and soft rollers disposed between said top roller and said bottom roller, said roller stack being loaded in the direction of the stack by means of a force acting upon one of the top roller and the bottom roller;

a working nip being formed between the juncture of each hard roller and soft roller; and a changeover nip being formed between the juncture of two soft rollers, one of said two soft rollers forming said changeover nip being comprised of a fixed carrier and an outer jacket disposed about and supported on said fixed carrier, said one of said two soft rollers forming said changeover nip being a deflection adjustment roller having an upper support device and a lower support device, each of said support devices exerting a supporting force on said jacket, the supporting force exerted by said upper support device being greater than the supporting force exerted by said lower support device.

2. A calender according to claim 1, wherein said one of said two soft rollers is the fifth roller from the top of said roller stack.

3. A calender according to claim 2, wherein said plurality of intermediate rollers, with the exception of said one of said two soft rollers, are each mounted on levers that are loaded by compensators to minimize the effective weight of said respective intermediate rollers.

4. A calender according to claim 3, wherein the sum of the line loads applied in said working nips disposed above said changeover nip is between 80 percent and 120 percent of the sum of the line loads of said working nips disposed below said changeover nip.

5. A calender according to claim 4, wherein the sum of the products of the dwell time and the average compressive stress in said working nips disposed above said changeover nip is between 80 percent and 120 percent of the sum of the products of the dwell time and the average compressive stress in said working nips disposed below said changeover nip.

6. A calender according to claim 5, wherein said soft rollers each have an internal cavity.

7. The calender according to claim 6, wherein said soft rollers each have an outer plastic jacket.

8. The calender according to claim 7, wherein said outer jacket is made of fiber-reinforced plastic.

9. The calender according to claim 8, wherein at least one hard roller includes a means for heating a surface of said hard roller.

10. The calender according to claim 9, wherein at least one of said top roller and said bottom roller includes a means for heating a surface of said hard roller.

11. The calender according to claim 10, wherein at least one of said top roller and said bottom roller is a deflection adjustment roller.

* * * * *